US005170600A

United States Patent [19]

Terrell

[11] Patent Number: 5,170,600

[45] Date of Patent: Dec. 15, 1992

[54] PREFABRICATED HOUSING ADDITION

[76] Inventor: Mark Terrell, 36 Arrowhead Rd., Saratoga Springs, N.Y. 12866

[21] Appl. No.: 665,256

[22] Filed: Mar. 6, 1991

[51] Int. Cl.[5] ..... E04B 2/70

[52] U.S. Cl. ..... 52/90; 52/284; 52/286; 52/586

[58] Field of Search ..... 52/90, 233, 270, 271, 52/586, 589, 590, 591, 593, 595, 690, 691, 286, 92, 284, 281, 274, 656

[56] References Cited

U.S. PATENT DOCUMENTS 1,444,798 2/1923 Laughlin ..... 52/92
3,076,286 2/1963 Czecholinski ..... 52/90 X
3,774,362 11/1973 Matuschek et al. ..... 52/90 X
4,688,362 8/1987 Pedersen et al. ..... 52/286 X
4,840,003 6/1989 Lucas et al. ..... 52/233

FOREIGN PATENT DOCUMENTS 10840 of 1906 United Kingdom .

*Primary Examiner*—Richard E. Chilcot, Jr.
*Assistant Examiner*—Robert Canfield
*Attorney, Agent, or Firm*—Schmeiser, Morelle & Watts

[57] ABSTRACT

The invention is a prefabricated housing addition that can be used either as a room addition or to enclose a porch or patio. A number of specially designed joints are used to facilitate the assembly of the addition. These joints are adapted to be easily made by machine and to provide the structure with great strength and rigidity.

16 Claims, 4 Drawing Sheets

PREFABRICATED HOUSING ADDITION

FIELD OF THE INVENTION

The invention is in the field of prefabricated structures. More particularly, the invention is a prefabricated housing addition that is adapted to facilitate its assembly.

BACKGROUND OF THE INVENTION

When a homeowner wishes to enclose a porch or to add a room to his or her house, a contractor is normally retained to construct the addition. The contractor usually employs standard plans and orders the necessary building materials. Once the building materials are delivered to the worksite, the contractor will bring in a construction crew to cut and shape the lumber as required and then to erect the structure under the supervision of the contractor.

The procedures used to construct a room addition or to enclose a porch are approximately the same as are used to construct a new home. Each piece of lumber is first cut to length if necessary and then is joined to adjacent members using common butt joints with nail-type fasteners. On the whole, a large degree of expertise is required of the contractor and the contractor's crew to successfully construct a housing addition.

There are a number of disadvantages associated with the construction techniques that are presently used for building house additions. Firstly, the level of expertise required is such that a typical homeowner is incapable of carrying out the construction without professional help. Secondly, the construction process is extremely time consuming and labor intensive. This is partially the result of having to cut and shape the raw lumber so that its dimensions are in accordance with that required by the plans. Lastly, the cost to build a housing addition is relatively high since no mass production techniques are involved in either the preparation of the materials or during the actual on-site construction process.

It is a first object of the invention to provide a prefabricated housing addition that does not require a significant amount of expertise to assemble. In the preferred embodiment, the walls and roof of the structure are provided in kit form and the homeowner can buy the kit and assemble it without skilled aid. This type of prefabricated unit can also be advantageously used by the professional contractor since its use allows a significant reduction in the erection time and a concommitant cost savings. In addition, the construction crew is not required to have the same level of skill as was required by the prior art building techniques.

It is a second object of the invention to provide a method of prefabricating a room structure so that the structure can be quickly assembled at the worksite. This is accomplished by precutting the lumber and the connecting joints.

A third object of the invention is to reduce the cost of a housing addition by providing a unique joint structure that lends itself to mass production and can be quickly and easily assembled at the worksite. The joint design enables a transfer of loading not found in the prior art butt joints. Once the structure is fully assembled, the joint design maintains the position of interconnected members without any looseness or bending.

The simplicity and prefabricated nature of the kit allow the homeowner to buy a room unit in kit form and thereby avoid the expense of hiring a contractor. If a contractor is retained to build the unit, a cost savings will still result due to the reduced time and skill required during the assembly process. After a contractor's crew has assembled one kit, they then have the experience to assemble future similar kits in even less time thereby bringing a modicum of mass production efficiency into the on-site construction process.

SUMMARY OF THE INVENTION

The invention is a prefabricated housing addition that employs specially designed joints for the purpose of facilitating the unit's assembly. The housing addition consists of a unique wall structure, either standard or prefabricated flooring and a standard roof structure. The unit is designed to be assembled in a minimum of time using little or no skilled labor. Since the unit makes use of high volume manufacturing techniques, the cost per unit is minimized. The room unit can be used for enclosing a porch or as a room addition.

At most connection points between adjacent members, one of a variety of unique types of dove-tail like joints are used. A side view of a medial joint presents an arrow-shaped cutout through which two adjacent members may be securely inserted. End located joints present a cutout that has a modified "V"-shaped profile and are designed to support the necessary loading involved. Each of the cutouts is made along two perpendicular intersecting axes and are designed to be machine made in a rapid manner. Any member that is connected to one of the connector joints has located on its end a complementary projection sized and shaped to snugly fit within the cutout of the joint. Due to the nature of the joints, additional fixing type fasteners such as nails are not required but are commonly used to initially fix the members in place and to comply with building regulations.

A housing addition in accordance with the invention makes use of prefabricated studs, crossmembers and corner posts in the walls of the structure. The flooring and roof are normally provided in either a prefabricated or standard form. The entire addition or just the walls of the addition can both be provided in kit form with each included member precut to length and having any necessary adapted end portions and cutouts.

Once the basic wall structure has been erected, windows and cover panels may be placed in suitable locations in the walls. The framework will normally also include grooves cut adjacent the outer edges of the studs and crossmembers. The grooves are designed to properly receive the outer perimeter of panels with tongue type prefabricated edges. A rabbet-type joint can also be used to attach windows to the framework so that they fit in a flush manner within the surrounding framework.

A door or doors may also be placed within the walls of the structure using prefabricated members fixed to the adjacent members by dovetail type joints. Once the door's outer framework is in place, the door is hung in the normal fashion.

It should be noted that prefabricated building techniques are known in the prior art. However, prefabricated wall structures using the specially designed joints of the invention are not found in the prior art.

In a British patent (number 10840), O. Rua teaches a building method for erecting wooden houses that eliminates the use of nails or screws during the assembly process. This is accomplished through the use of standard dovetail joints to connect adjacent members.

The invention makes use of specially designed joints that can be machine made. The design of the joints provides the user with an ease of assembly not found in the prior art structures of this type. The joints are oriented to allow an improved transfer of loading forces without significantly affecting the strength of the connected members. Once the structure is completely assembled, most of the joints are completely hidden when viewed from outside the completed room.

DETAILED DESCRIPTION OF THE DRAWINGS

Figure 1:
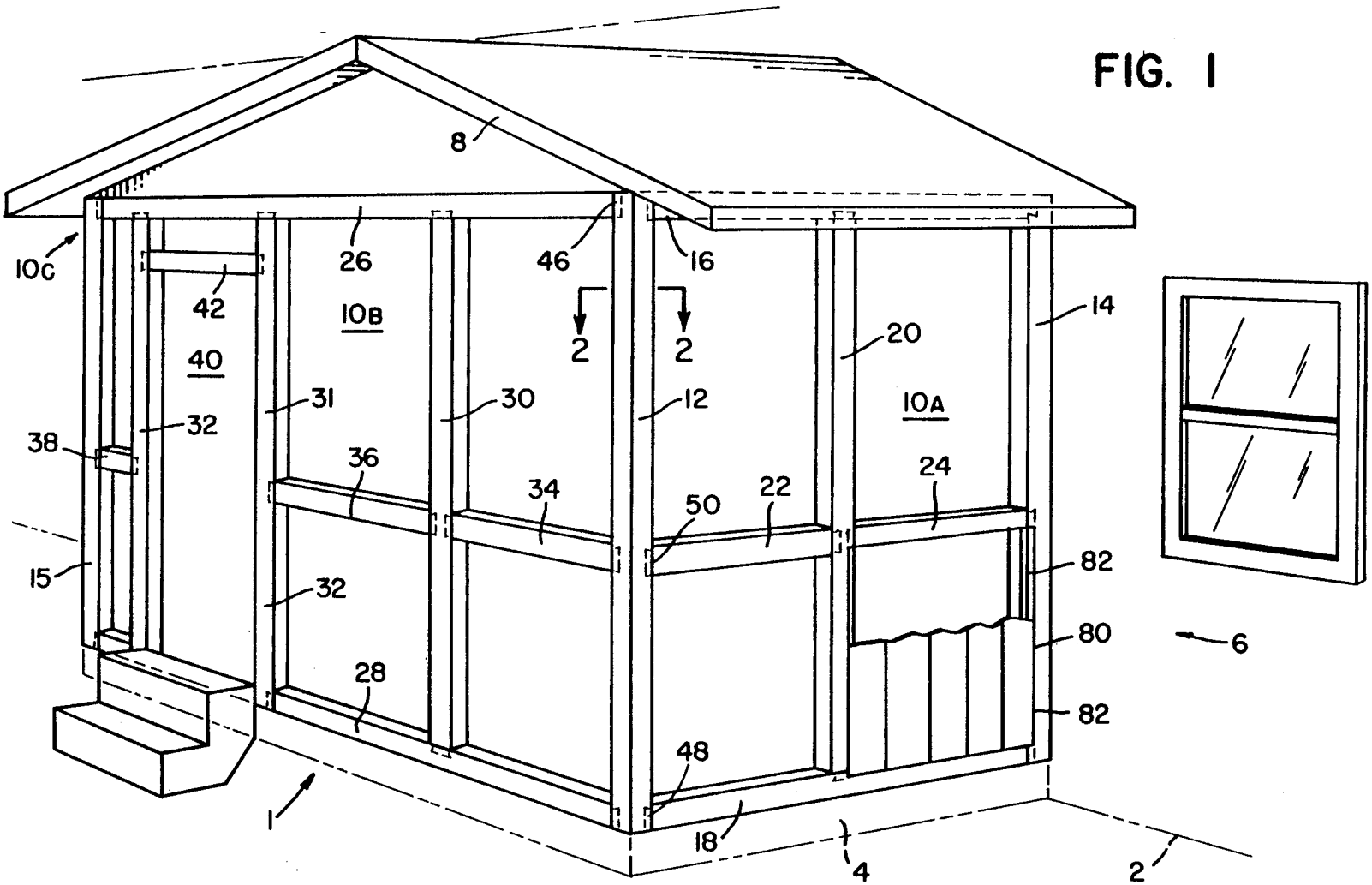
FIG. 1 is a perspective view of a prefabricated housing addition in accordance with the invention.

Referring now to the drawings in greater detail wherein like reference characters refer to like structure within the several figures, there is shown by the numeral 1 a prefabricated housing addition in accordance with the invention. The housing addition 1 is shown attached to a house 2.

The housing addition is located atop a foundation 4 and comprises a roof structure 8 that rests on three sidewalls 10*a*, 10*b* and 10*c*. Wall 10*c* is not shown but is identical and parallel to wall 10*a*. A number of dovetail-like connections that are used in the sidewalls to connect adjacent members are shown in phantom in FIG. 1. The joints are normally only visible from the interior of the structure but can extend through the members and be visible from the exterior of the structure as well. Each sidewall extends between two corner posts and normally includes a number of intermediary studs and crossmembers.

Concentrating on the addition shown in FIG. 1, wall 10*a* is connected to wall 10*b* by corner post 12. Wall 10*a* is connected to the house by corner post 14. Extending between corner posts 12 and 14 is an upper crossmember (top plate) 16 and a lower crossmember (sole plate) 18. A vertical stud 20 extends between crossmembers 16 and 18 and provides a vertical support between the corner posts. Extending horizontally from a medial location on the stud to each corner post is a pair of short crossmembers (cats) 22 and 24.

Wall 10*b* is similar to wall 10*a* with an upper horizontal crossmember 26 and a lower horizontal crossmember 28. The crossmembers extend between corner posts 12 and 15. In the wall shown, crossmember 28 includes a gap in order to receive the bottom portion of a door. Since wall 10*b* is longer than wall 10*a*, it has three intermediary studs 30, 31 and 32 with a corresponding increased number of short horizontal crossmembers 34, 36 and 38. Wall 10*b* also includes a door opening 40 that is adjacent to stud 32 and is framed by the horizontal header 42 and studs 31 and 32.

Each of the corner posts has a specially designed top connection and a specially designed bottom connection. The outer corner posts 12 and 15 also have a specially shaped medial connection 50 designed to receive the shaped ends of two orthogonally oriented short crossmembers. In FIGS. 2–8, these novel connections are shown in greater detail.

Figure 2:
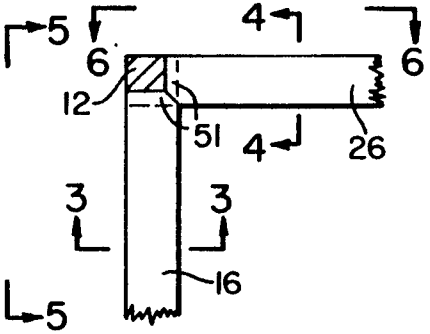
FIG. 2 is a plan view of a corner of the housing addition shown in FIG. 1.

FIG. 2 is a plan view of a portion of the structure taken at a location just above corner post 12 with the roof structure removed for clarity. In this view can be seen the top of the corner post and the top surface of the adjacent upper crossmembers 16 and 26. Each crossmember includes a mitered portion adjacent its end so that the two crossmembers will be flush against each other adjacent the corner post.

Figure 3:
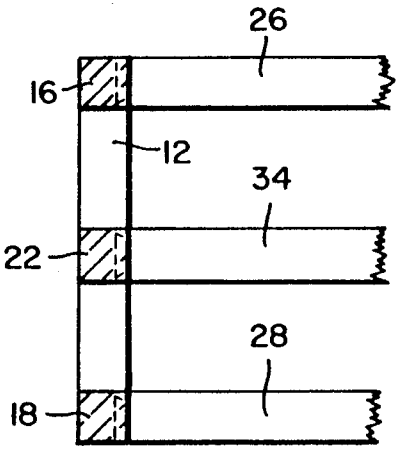
FIG. 3 is a cross-sectional view taken through one of the walls adjacent to the corner shown in FIG. 2.

FIG. 3 is a side cross-sectional view taken through wall 10*a* adjacent to corner post 12. The shaped end portions of members 26, 34 and 28 are shown in phantom.

Figure 4:
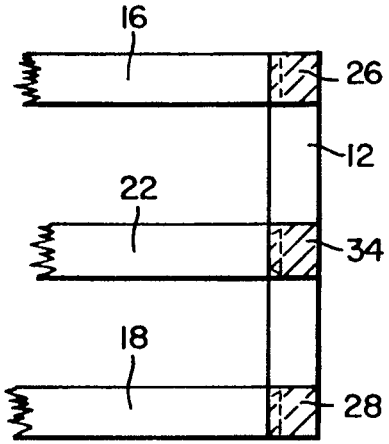
FIG. 4 is a cross-sectional view taken through the other of the walls adjacent to the corner shown in FIG. 2.

FIG. 4 is a side cross-sectional view taken through wall 10*b* at a location adjacent to corner post 12. The shaped end portions of members 16, 22 and 18 are shown in phantom.

Figure 5:
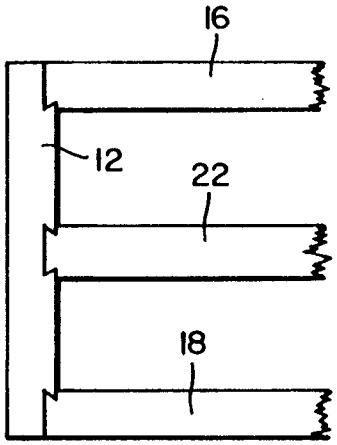
FIG. 5 is a side view of the corner shown in FIG. 2.

FIG. 5 is a side view of a portion of wall 10*a* adjacent to corner post 12. In this view, the exterior of the shaped end portions of members 16, 22 and 18 can be seen as well as the shaped cutouts in the corner post in which they are received.

Figure 6:
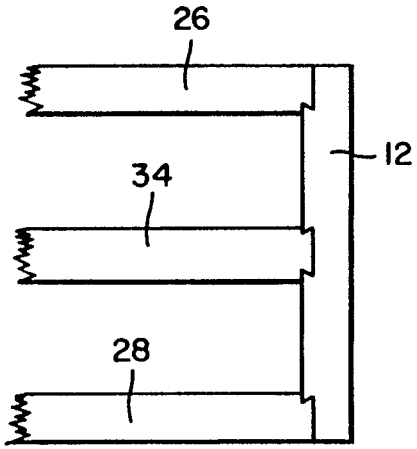
FIG. 6 is a side view of the corner shown in FIG. 2 taken perpendicularly from the view shown in FIG. 5.

FIG. 6 is a side view of a portion of wall 10*b* adjacent to corner post 12. Similarly to FIG. 5, the exterior of the shaped end portions of the connecting members can be seen being received within complementary cutouts in the corner post.

Figure 7:
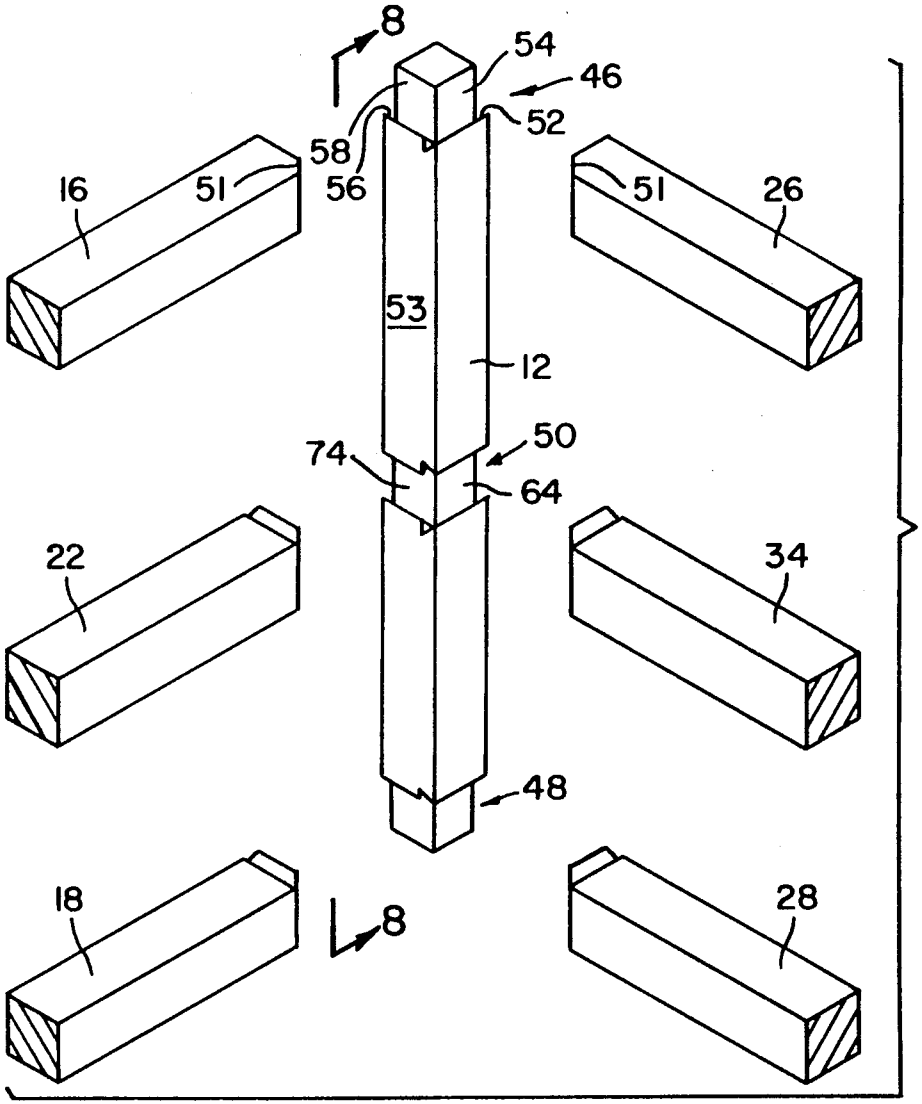
FIG. 7 is an exploded view of the corner shown in FIG. 2.
Figure 8:
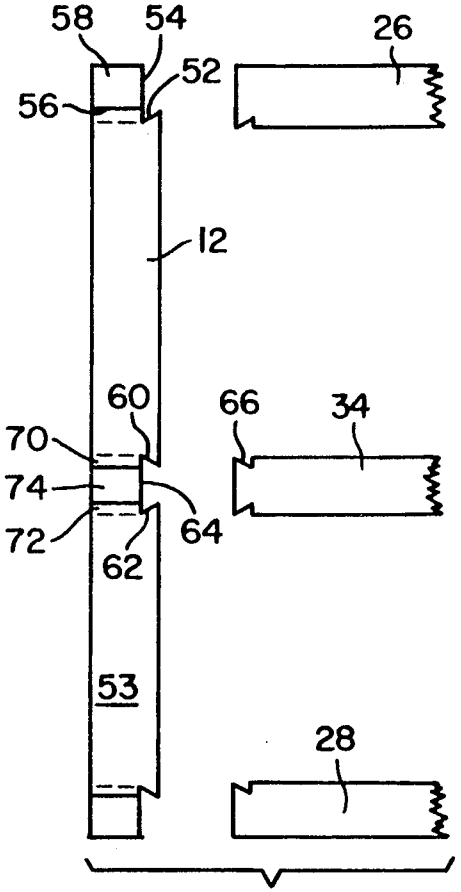
FIG. 8 is a side view of a portion of the corner shown in FIG. 2.

FIGS. 7 and 8 are exploded views of corner post 12 and the members that are received within its specially shaped cutouts. The top cutout or connection 46 is formed out of two intersecting "V"-shaped cuts that have one arm of the "V" oriented parallel to the longitudinal axis of the corner post and the other arm extending outwardly at an angle of approximately forty-five degrees to the first arm. As shown, the outer arm 52 of the cut designed to receive member 26 extends for the full width of the corner post while the cut's inner arm 54 extends for only a portion of the width of the corner post. It should also be noted that the inner arm 54 extends to the top of the corner post while the outer arm extends for only a portion of the distance to the top of the post. Both the outer and inner arms 56 and 58 respectively of the cut that receives member 16 extend for only a portion of the width of the corner post. The shape of cutout 46 is such that it can easily be made by machine. This is accomplished by first passing the corner post through the cutter along one face of the post (to make the cut bounded by arms 52 and 54) and then rotating the corner post ninety degrees and passing it again through the same cutter (to make the cut bounded by legs 56 and 58).

The bottom cutout 48 is made in the same way as the top cutout except that the "V"-shaped cut is inverted.

The middle cutout 50 has a different shape than either the top or bottom cutouts and is designed to receive male dovetail shaped end portions of members 22 and 34. As can be seen in FIGS. 7 and 8, the middle cutout is a combination of the top and bottom cutouts. To make the cutout, a female dovetail shaped cut is made on each of two adjacent sides of the corner post at a location where the two cuts will intersect at one end. The cutout appears arrow shaped when looking directly at face 53 of the corner post (note FIGS. 7 and 8).

FIG. 8 shows a side view of the corner post (viewing directly at face 53) with a portion of members 26, 28 and 34 located adjacent the post. Cutout 50 is made by machining two orthogonal intersecting cuts in the corner post. The cut designed to receive member 34 is bounded by two outer legs 60 and 62 and a vertical inner wall 64. Member 34 includes a male dovetail shaped end portion 66 that can be inserted through one of the open sides of the cut and is sized to match the shape of the opening. It should be noted that the portion of the cutout adapted to receive member 34 extends for the full width of the corner post.

Member 22 is received within the second cut of cutout 50. The second cut extends for only a portion of the width of the corner post and is made up from two outwardly extending leg portions 70 and 72 and has a flat vertical inner face 74. The design of cutout 50 is such that it can be cut into the corner post using a single shaped cutter that cuts first across one side of the corner post and then across an adjacent side.

All of the specially shaped joint connections are designed to facilitate their manufacture and the later assembly of the structure. As previously noted, each cutout can be made using two passes through a shaped cutter. The joint design allows for a rapid and uncomplicated assembly of the joint. Once the joint is assembled, the joined members are rigidly fixed allowing for a full transference of any associated loading.

Figure 10:
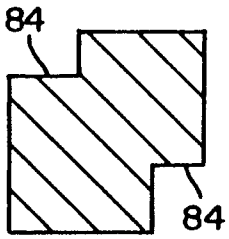
FIG. 10 is a cross-sectional view of the corner post shown in FIG. 9.
Figure 9:
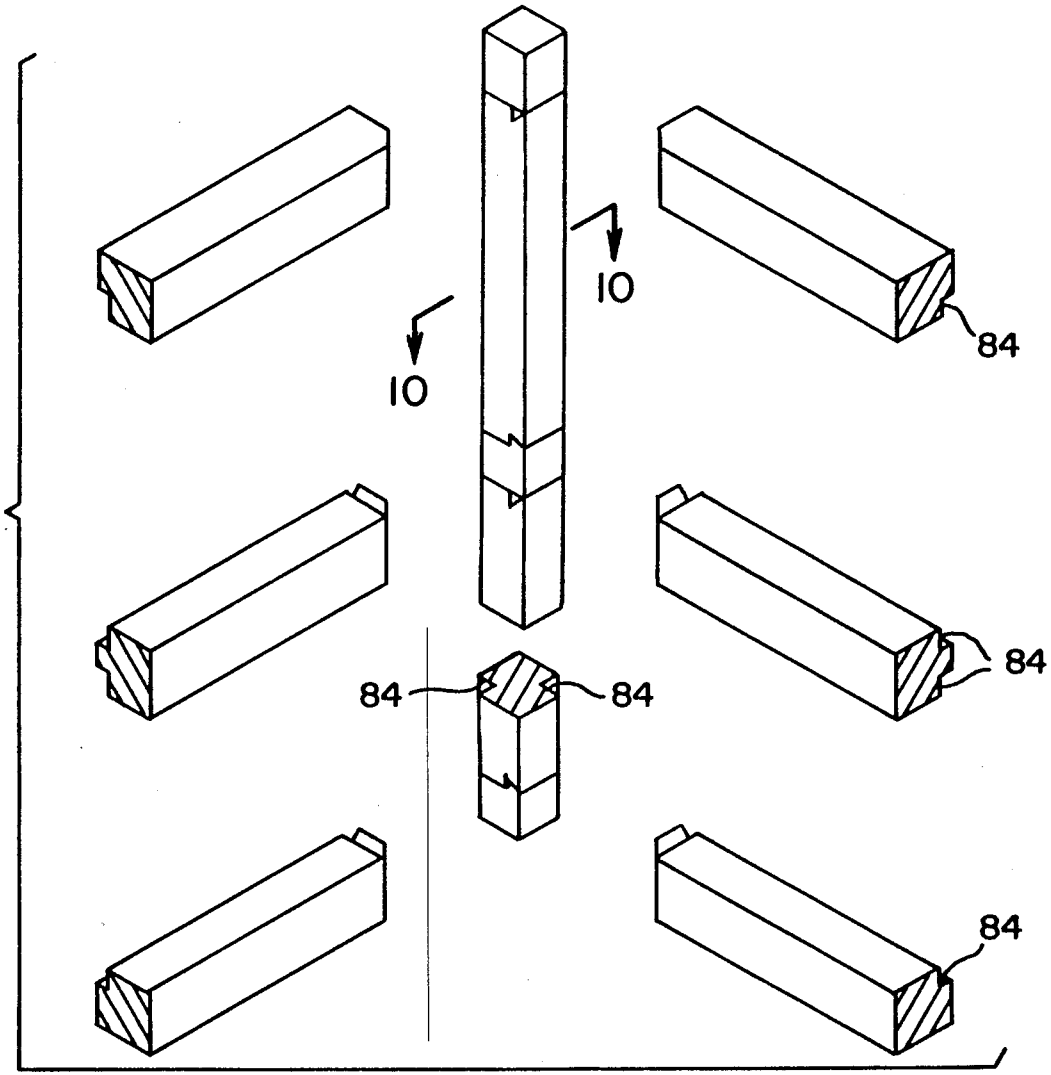
FIG. 9 shows the corner post assembly of FIG. 7 in which the optional recesses are included.

FIG. 9 shows a typical corner post of the structure in which the optional recesses 84 have been cut in the members. The recesses (rabbets) facilitate the insertion of the outer edge of the windows, panels or door(s) that are placed within the framework to complete the structure. FIG. 10 is a cross-sectional view of the corner post showing the location of the recesses.

To assemble a housing addition from a prefabricated kit made in accordance with the invention, the following procedure is basically followed.

The base 4 is first prepared. This entails either laying a foundation if one is not already present, or the leveling and cleaning of an existing foundation. The latter condition is applicable when the kit is being used to enclose an existing outdoor patio or porch.

The next step is the assembly of the sidewalls (such as wall 10*a*). To accomplish this, one first lays out each corner post and then slides the upper and lower crossmembers (for example, members 16 and 18) into their respective positions in the upper and lower corner post cutouts (in wall 10*a*, this would involve placing members 16 and 18 into corner posts 12 and 14). Following this, the dovetailed stud(s) are attached to female dovetail cutouts located in the crossmembers (for example, in wall 10*a*, stud 20 is attached between crossmembers 16 and 18). The intermediary dovetailed crossmembers are then attached between the stud(s) and to the middle cutouts in the corner posts. It should be noted that suitable complementary cutouts are made in the stud(s) during the prefabrication process. At this point, the basic frame for each end sidewall is complete. The end sidewalls are next placed on the foundation in a vertical position and temporarily attached to the outer wall of the house.

The outer wall 10*b* of the addition is next assembled by attaching its upper and lower crossmembers (26 and 28) to the outer corner post of each sidewall. In FIG. 1, this would correspond to attaching members 26 and 28 to corner posts 12 and 15. The studs (30, 31 and 32) are attached at their top and bottom ends to the crossmembers with the dovetail joints shown. Next, the intermediary crossmembers are attached between the studs and between the studs and the corner post cutouts 48. The basic outer framework for the addition is now complete.

A roof is then built atop the room framework to complete the initial framing. It should be noted that the roof framework can be made in the conventional manner or itself be of a prefabricated design.

The next stage of construction is a finishing operation in which panels or windows are placed on the framework and set into preexisting grooves cut into the members for this purpose. This is shown in FIG. 1 with a number of panels 80 fixed to the frame located grooves 82. The panels are preferably also prefabricated with a tongue-type edge sized and shaped to fit into the grooves provided along the appropriate interior edges of the framework. It should be noted that when using a tongue-and-groove attachment for the panels, the panels may have to be inserted during the initial joining of the framework (i.e. when the crossmembers are first connected to the studs and corner posts). Alternatively, a rabbet-type connection can be used to properly position the panels, windows or door(s) with a cover strip or nails then added to secure the panels, etc. in position. FIGS. 9 and 10 show this alternate arrangement in which recesses 84 have been cut in the members. Additionally, grooves may be cut adjacent the edges of the framework for the purpose of receiving the outer edge of screening that may be placed within any of the framed openings.

The embodiment of the invention disclosed herein has been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention.

I claim:

1. A prefabricated housing addition kit comprising:

first and second corner posts wherein each of said corner posts has a top end, a bottom end and an elongated body extending between said top and bottom ends;

a plurality of crossmembers having shaped end portions;

a plurality of studs having shaped end portions;

a plurality of intermediary crossmembers having shaped end portions;

a first shaped cutout located proximate the top end of said first and second corner posts, said cutout extending substantially across two adjacent sides of each of said corner posts and having a shape that can inwardly receive the shaped end portions of a first and second crossmember;

a second shaped cutout located proximate the bottom end of said first and second corner posts, said cutout extending substantially across two adjacent sides of each of said corner posts and having a shape that can inwardly receive the shaped end portions of a third and fourth crossmember; and a third shaped cutout located in said first and second corner posts between said bottom and top ends of said corner posts, said cutout having a shape wherein it can inwardly receive the shaped end portions of two perpendicularly oriented intermediary crossmembers.

2. The kit of claim 1 wherein said third shaped cutout in said corner posts extends substantially across two adjacent sides of the associated corner post.

3. The kit of claim 1 further comprising roofing materials for forming the roof of the addition.

4. The kit of claim 2 wherein said first, second and third cutouts are oriented in a manner whereby an end portion of a member that is to be received within any of said cutouts is placed into the associated cutout by moving said member in a direction perpendicular to a longitudinal axis of the associated corner post.

5. The kit of claim 2 wherein said first, second and third cutouts are each formed from two intersecting substantially symmetrical cuts in the associated corner post.

6. The kit of claim 5 wherein the two cuts that form each cutout intersect at a point proximate a longitudinal outer corner of the associated corner post.

7. A prefabricated housing addition comprising:

a plurality of corner posts;

a plurality of horizontal crossmembers extending between said corner posts, said crossmembers having shaped end portions;

a plurality of vertical studs extending between said crossmembers;

a roof located above said corner posts;

a foundation located below said crossmembers; and wherein at least two of said corner posts include prefabricated cutouts sized to receive the shaped end portions of said crossmembers and wherein each of said cutouts comprises two substantially perpendicular cuts that extend across at least a portion of two adjacent sides of the associated corner post and intersect proximate a longitudinal corner of the associated corner post.

8. The addition of claim 7 wherein the two cuts that make up each of said cutouts are substantially identical in shape and are located symmetrically about a longitudinal center axis of the associated corner post.

9. The housing addition of claim 7 wherein said at least two corner posts each include a top cutout, a bottom cutout and an intermediary cutout located between said top and bottom cutouts.

10. The housing addition of claim 9 wherein said top cutout comprises two intersecting substantially "V"-shaped cuts.

11. The housing addition of claim 9 wherein said bottom cutout comprises two inverted substantially "V"-shaped cuts.

12. The housing addition of claim 9 wherein said intermediary cutout is formed from two cuts wherein each cut has a shape similar to a truncated triangle and which are substantially perpendicularly oriented and intersect proximate a longitudinal corner of the associated corner post.

13. The housing addition of claim 12 wherein said intermediary cutout when viewed from one side is substantially arrow-shaped.

14. The housing addition of claim 12 wherein one of said two cuts that form said intermediary cutout is longer than the other of said two cuts that form said intermediary cutout.

15. The housing addition of claim 7 wherein said crossmembers include female dovetail-type cutouts that are sized and shaped to inwardly receive male dovetail-type projections that are located on end portions of said studs.

16. The housing addition of claim 9 wherein each of the cutouts has an orientation that required the associated crossmember to be initially inserted into the cutout in a direction perpendicular to a longitudinal axis of the associated corner post.

* * * * *